United States Patent [19]

Kreidler

[11] 4,075,881

[45] Feb. 28, 1978

[54] METHOD OF AND DEVICE FOR MAKING RODS, TUBES AND PROFILED ARTICLES

[75] Inventor: Alfred Kreidler, Zurich, Switzerland

[73] Assignee: Metall-Invent S.A., Zug, Switzerland

[21] Appl. No.: 637,817

[22] Filed: Dec. 4, 1975

[30] Foreign Application Priority Data

Dec. 5, 1974 Germany ..... 2457423

[51] Int. Cl.[2] ..... B21C 33/02

[52] U.S. Cl. ..... 72/270; 164/76; 164/270; 72/273

[58] Field of Search ..... 164/26, 270; 72/270, 72/253, 273

[56] References Cited

U.S. PATENT DOCUMENTS

| | | | |
|---|---|---|---|
| 1,850,668 | 3/1932 | Harris | 72/270 |
| 3,328,994 | 7/1967 | Lindemann | 72/270 |
| 3,625,045 | 12/1971 | Riemann | 72/270 |

*Primary Examiner*—Leonidas Vlachos
*Attorney, Agent, or Firm*—Walter Becker

[57] ABSTRACT

A method of and device for making rods, tubes and profiled articles directly from a melt, especially metallic melt, by extrusion pressing by means of a forming tool and die. The melt charged into a receiving compartment of the device in successive batches is cooled so as to be transformed into a thermal-plastic condition. There is a build up layer by layer to form a bar and alternately with the charging of the receiving compartment the bar stepwise is subjected to pressure to extrude a portion of a strand.

21 Claims, 10 Drawing Figures

METHOD OF AND DEVICE FOR MAKING RODS, TUBES AND PROFILED ARTICLES

The present invention relates to a method for manufacturing rods, tubes, profiled sections and the like directly from a molten mass, and particularly a molten metal mass, and to an apparatus suitable for carrying out the method.

The method of extrusion pressing metal has already been known for many decades in which the molten mass is cast into a receiver of an extrusion press whereupon the bar formed in the receiver is pressed out by means of a shaping tool and die at the same heat to form an extrusion or strand. This method has not been adopted by industry because it has not been possible to achieve a uniform structure through the full cross-section of the bars nor a uniform thermal condition, and particularly, the correct pressing temperature, for the whole bar or ingot.

By means of the method according to the invention, the above mentioned defects have been obviated. At the same time a saving in labor is achieved and finally the possibility is realized of producing by a continuous or quasi-continuous process a pressed extrusion or strand of unlimited volume. With the heretofore conventional extrusion press procedure, the volume and length of the extrusions, tubes, profiled sections and the like to be produced was limited by the holding capacity of the receiver and therefore dependent on the size of the press. As, nowadays, larger and larger dimensions are demanded, ever larger presses have to be used, with correspondingly increased space requirement and constructional expenditure. Due to the fact that, according to the invention, extrusions of any desired volume can be manufactured independently of the size of the press there results quite a considerable saving in installation costs.

These and other objects and advantages of the invention will appear more clearly from the following specification in connection with the accompanying drawings, in which.

The method according to the invention is characterized primarily in that successive layers of the molten material are introduced into the receiver and are cooled to a thermal plastic condition for the layer-like construction of a bar which alternately with the charging and at a rate which corresponds to the quantity of the respective introduced layer, is extruded by means of a die which reversibly enters the receiver.

According to a further feature of the invention, the extrusion pressure is applied during the transition of the last inserted layer of molten mass from the liquid state into the plastic condition. A uniform spreading of the newly inserted layer of molten mass over the whole surface of and a satisfactory fusion with the already solidified bar, and the most advantageous grain structure or structure formation are thus achievable.

The method is suitably practiced in such a way that the bar being built up in the receiver is only cooled to such an extent that, at least in the entry region of the shaping tool, the cooled bar reaches the pressing temperature. In certain circumstances it has proved necessary to re-heat the bar in the receiver, to bring the same to the temperature required for extrusion. In order to achieve a more rapid cooling of the inserted layer, the area of the cooling surface is increased by suitably shaping the receiver, for example, to a conical or hyperboloid surface or the like; if necessary, that cylindrical part of the bar adjacent the profiled cooling surface is heated.

For reasons of space it is advisable to carry out the stepwise pressing out of the extrusion as an extrusion press procedure.

Figure 1:
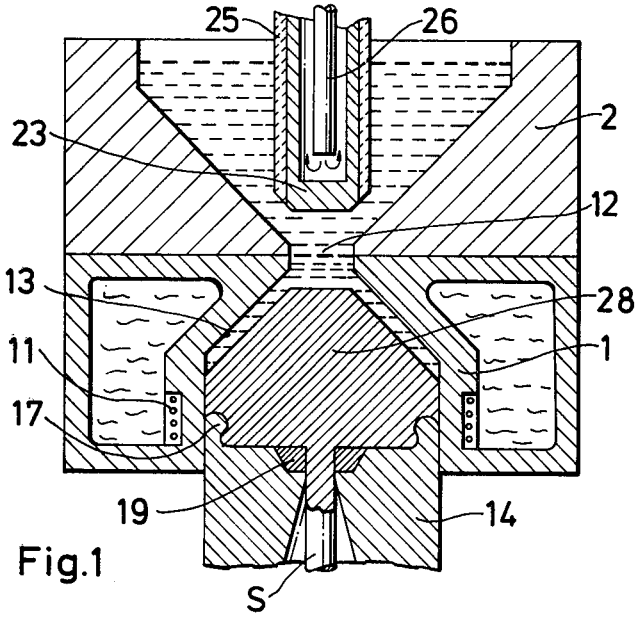
FIGS. 1 and 2 are general diagrams illustrating the principle of the invention.
Figure 2:
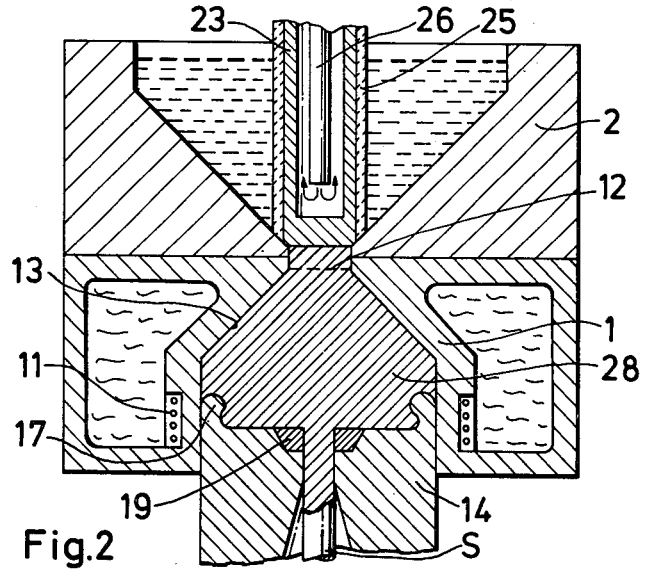

Referring now to the drawings in detail, FIGS. 1 and 2 show, in longitudinal section, a receiver 1 and a casting funnel 2 superimposed thereon, tne receiver 1 having a cooling jacket thereabout, the receiver and casting funnel being in fluid flow communication with each other through a pasage 12. Adjacent to the passage 12, the inner space of the receiver is defined by a conical cooling face 13. A hollow die 14 is adjustably introduced into the receiver 1. Such die is equipped with holding member 17 at the periphery thereof for retention of the press bar 28 and a centrally disposed shaping tool 19 aligned with the longitudinal bore through the die. The hollow die 14 is movable upwardly and downwardly relative to the receiver 1, the stroke of the die being determined by the quantity of fused mass to be inserted and pressed out. A stopper 23 is provided for closing the passage opening 12, such stopper having a heat damping, fire-proof jacket 25 and an inner space which is cooled by water supplied through a tube 26. The lower, cylindrical part of the receiver 1 is surrounded by a heating coil 11.

At the beginning of the process, the inner space of the receiver 1 is filled with fused mass from the casting funnel 2, the stopper 23 being disengaged from the passage opening 12, and the opening 12 is then closed by suitable adjustment of the stopper 23. The fused mass introduced in the receiver is solidified to a heat plastic state, and the hollow die 14 is progressively engaged in the receiver 1 by a distance determined by the stroke of the die 14 and, by means of the shaping tool 19, a corresponding extrusion section is pressed out. If necessary the heating coils 11 are utilized to maintain a thermal state of the lower parts of the bar 28 adjacent the entry region of the shaping tool 19 appropriate for satisfactory extrusion.

Upon completion of this first pressing stroke, the press die 14 returns to its initial position, engagement of the holding member 17 with the bar 28 insuring that such bar 28 moves with the die 14, thereby creating an annular space between the conical cooling face 13, fresh molten material and the opposed conical surface of the bar 28. On raising the stopper 23 molten material flows into the thus formed annular space, as is illustrated in FIG. 1, the newly introduced material fusing with the bar 28 present in the receiver and, on cooling due to contact with the cooling face 13, solidifies to the heat plastic state. In order to insure the complete filling of the hollow space present between the bar 28 and the cooling face 13, and the formation of a uniformly structured solidified layer, upon closure of the passage opening 12 by the stopper 23 the die 14 is progressively engaged with the receiver and this during the transition of the layer of newly introduced molten material from the liquid to the heat plastic state, so that the pressing out of a further section of the extrusion 8 is accomplished simultaneously with a favorable distribution and consolidation of the newly inserted molten mass.

The die 14 is again brought back to the starting position, the stopper 23 is removed from its engagement with the passage opening 12 and a further quantity of molten material is introduced into the receiver, this further quantity being fused with the then existing bar, being cooled by contact with the cooling face, and being consolidated with the existing bar for eventual extrusion through the shaping tool 19. This operation is repeated until an extrusion S of an appropriate length is formed.

Figure 3:
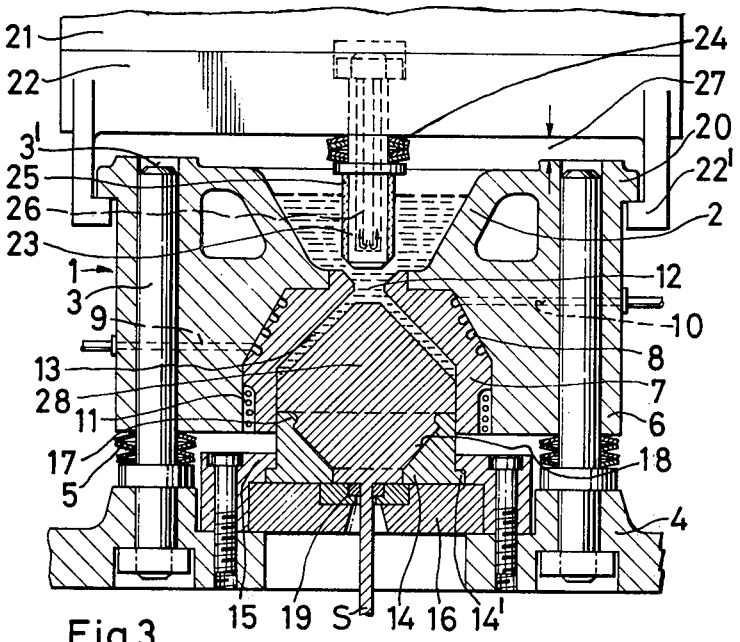
FIG. 3 is a vertical section through one embodiment of an apparatus for carrying out of the method of the invention, the relative positions of the parts corresponding to the commencement of the pressing stroke.
Figure 4:
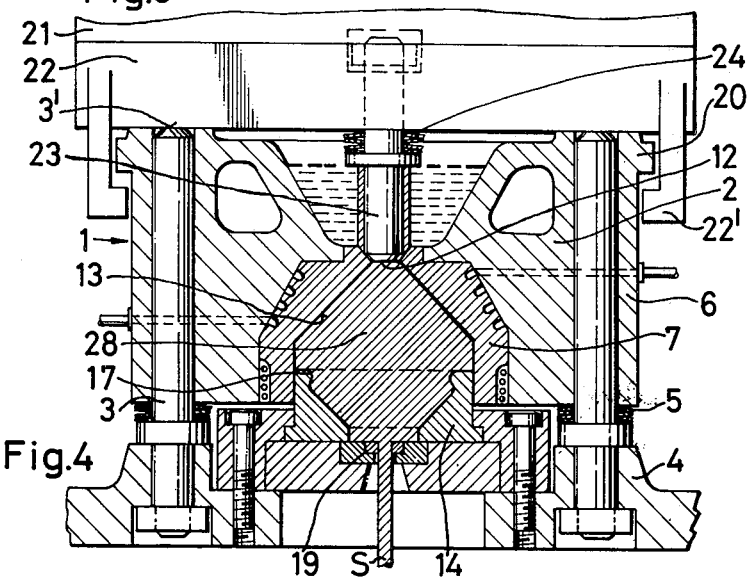
FIG. 4 illustrates in a view similar to that of FIG. 3, the relative disposition of parts at the end of the pressing stroke.

A practical form of the apparatus illustrated diagrammatically in FIGS. 1 and 2 is shown in FIGS. 3 and 4, the receiver 1 and the casting funnel 2 being arranged coaxial with the main axis of the press, and the whole assembly being guided on columns 3, which extend upwardly from a press counter-bearing 4 to which the columns are connected. For compensation of the weight, the casting funnel 2 and the receiver 1 are supported relative to the press counter-bearing 4 by dish springs 5. Receiver 1 comprises a receiver cover 6 and a receiver bush 7 which is screwed into or shrunk into such cover 6. At its upper conical section the bush 7 is provided with peripheral cooling flutes 8 to which cooling water is supplied and from which such water is led away through respective channels 9 and 10 provided in the receiver cover 6. Heating coils 11 are provided around a cylindrical section of the bush 7 adjacent to the conical part thereof.

The interior of the receiving bush 7 is in fluid flow connection with the casting funnel 2 through a passage opening 12, and the inner wall of the bush 7 adjacent the opening constitutes a conical cooling face 13. The hollow die 14 engages the bush 7 of receiver 1 from below, such die 14 having lateral projections 14' engageable by a holding ring 15 whereby the die, together with a carrier 16 upon which such die rests, is secured, by screws 15', to the press counter-bearing 4. The hollow die 14 has a beading 17 about the periphery, and at one end thereof, the beading serving to secure the bar 28 to the hollow die for movement therewith on relative motion between the die and the receiver, thereby to insure the creation of an annular space between the bar and cooling wall to receive a further quantity of molten material. The beading 17 will conveniently be in the form of a screw thread, thereby to facilitate separation of the die and bar on cessation of the extrusion operation. The inner face 18 of the hollow die 14 is of conical shape, converging towards the shaping tool, the shaping tool 19 conveniently being inserted into the die carrier 16.

The cover 6 of the receiver has lateral projections 20 which are engaged from below by jaws 22' of a pressure piece 22 secured to the pressure plate 21 of the press. For closing the passage opening 12 between the casting funnel 2 and the inner space of the receiver, there is provided a stopper 23 having a conically chamferred remote end. This stopper is secured bo the pressure piece 22 and is resiliently mounted relative thereto by a dish spring 24. The stopper 23 is provided with a heat damping fireproof cover 25 and is cooled from within by water delivered by a tube 26. Between the receiver 1 and the pressure piece 22 there is a "lost motion" 27 which slightly exceeds the closing stroke of the stopper 23. The downward stroke of the receiver 1 and of the pressure piece 22 is limited by its abutment against the ends 3' of the guiding columns 3.

In FIG. 3 the pressure piece 22 and the receiver 1 are shown in a raised position, the stopper 23 also being raised, and molten material from the casting funnel 2 being shown to have moved to fill the intermediate space between the conical cooling face 13 and the bar 28 as remaining after the completion of the previous pressing stroke. The incoming molten material forms a layer which is fused to material of the existing bar or ingot and, at the same time, solidifies uniformly by the cooling at the cooling face 13.

The pressure piece 22 is lowered, and the stopper 23 is moved correspondingly downward so that the bevel at its free end engages a seating at the passage opening 12 to effect closure of such opening. On further downward movement of the pressure piece 22 by a few millimeters, the dish springs 24 are compressed, and thus a tight closure is produced, and the pressure piece 22 moves into abutment with a receiver 1. A further movement by a like amount brings the pressure piece 22 into contact against the front face 3' of the columns 3. In this manner, by means of the die 14, the volume of the receiver is reduced and a portion of the bar 28, built up by applying successive layers of molten material and maintaining an appropriate pressing temperature, corresponding to the fused mass just inserted is pressed out by the shaping tool to form the extrusion S. The end of the pressing stroke is illustrated by FIG. 4.

On the next upward stroke of the pressure piece 22, the receiver 1 is raised by the jaw 22' and, after an initial "lost motion" before disengagement of the stopper 23 from the opening 12, molten material flows through the opening and into the free space formed between the cooling face 13 of the receiving bush 7 and the press bar 28, the press bar 28 being held down against upward movement with the receiver 1 by the beading 17 on the hollow die 14. The molten mass forms a new layer which fuses with the press bar 28 and solidifies due to the cooling effect of the cooling face 13. With a subsequent lowering of the pressure piece 22, the working procedure begins again.

In this way a pressed extrusion S as long as is desired is produced in stepwise manner as, during the actual casting and pressing procedure, new molten material can be fed from a casting furnace to the casting funnel 2 either continuously or discontinuously.

Figure 5:
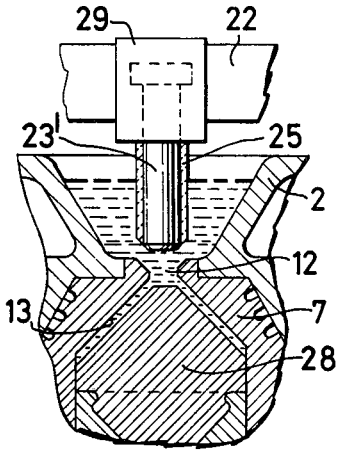
FIGS. 5 and 6 are fragmentary sections through a modified form of the above mentioned embodiment showing a relative disposition of parts corresponding to open and closed conditions, respectively, of the passage connecting the funnel and the receiver.
Figure 6:
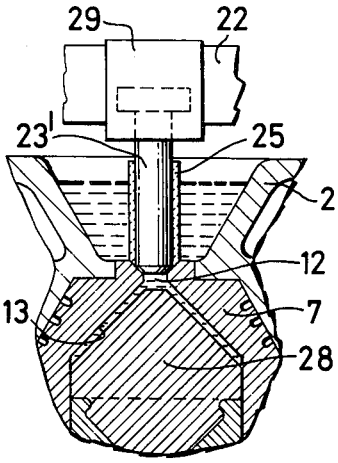

According to a variation of this construction, as FIGS. 5 and 6 show for improving the cooling of the conical cooling face 13 the stopper 23 is movable by a special displacement means therefor, for example a pressure cylinder 29, such that the stopper separates from the passage opening 12 on the casting funnel 2 (FIG. 5) for the influx of a new layer of molten mass during the upward movement of the receiver thereafter moving into engagement with the opening. There will thus result a heat insulating intermediate space between the cooling face 13 cooled from the outside as before and the held back hot press bar 28 (FIG. 6), whereby, so to speak, an accumulation of cooling volume is provided in the thick wall of the receiver bush 7.

Figure 7:
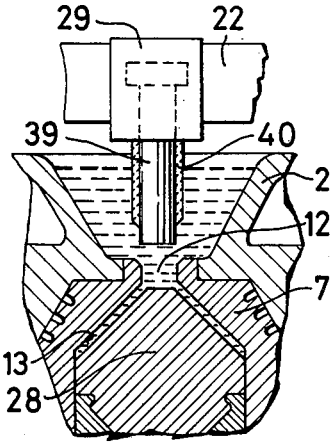
FIGS. 7 and 8 are fragmentary vertical sections corresponding to FIGS. 5 and 6, respectively, and illustrate a further modified form of the embodiment of the invention.
Figure 8:
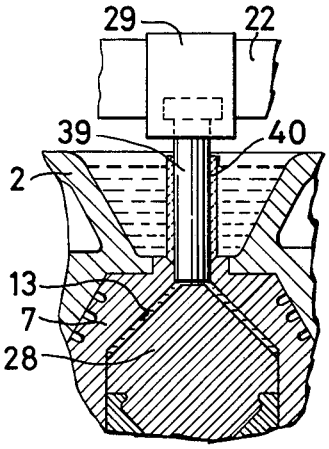

A further variation, shown in FIGS. 7 and 8, differs from the previous structure by the length and the greater stroke of the closing stopper between the casting funnel and the receiver. In the case of the arrangement shown, the stopper 39 can extend into a cylindrical passage opening 12 between the casting funnel 2 and the receiving bush 7. The annular end of the cover 40 is conical and is intended for cooperation with a corresponding seating on the passage opening 12. Thus, the newly introduced molten mass is compressed by the stopper 39 upon its introduction into the passage opening 12, until complete filling of the free space present above the bar 28, and furthermore, in addition to the closing effected by the stopper, the contacting of the conical chamfer of the cover 40 on the seating face on the passage 12 insures a press pressure-type closure. It is also possible that the cover 40 may be movable independently of the stopper 39 such that the stopper 39, apart from its front face, always remains inside the cover 40 and thus is protected from the destructive effect of the molten mass.

Figure 9:
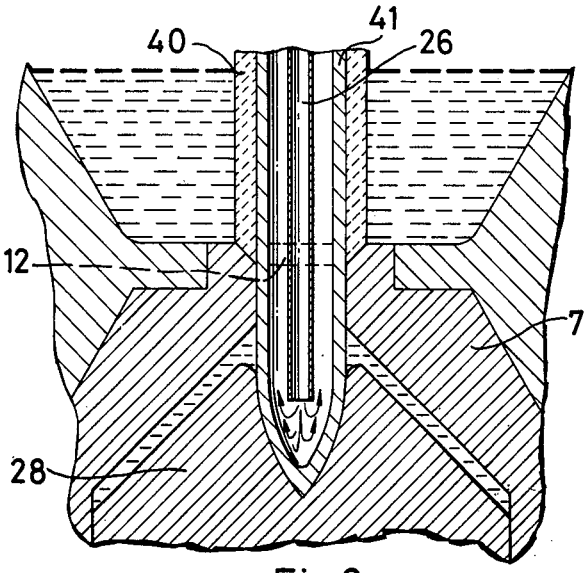
FIG. 9 shows a fragmentary section of a still further modified form of the embodiment shown in FIGS. 3 and 4.

In the variation according to FIG. 9 the closure stopper 41 has a tapered extremity thereto, such extremity in its "closed" position relative to the passage opening 12, projecting into the receiving bush 7, which, of course, assumes a correspondingly long stopper stroke. The stopper is cooled from the outside by cooling water fed through the pipe 26, with the result that the bar and the molten mass, in addition to the cooling action of the cooling face 13 is also cooled from within. The variation illustrated in FIG. 9 is particularly advantageous in receivers of relatively large diameter in order to achieve a rapid cooling of the material to the heat plastic condition.

Figure 10:
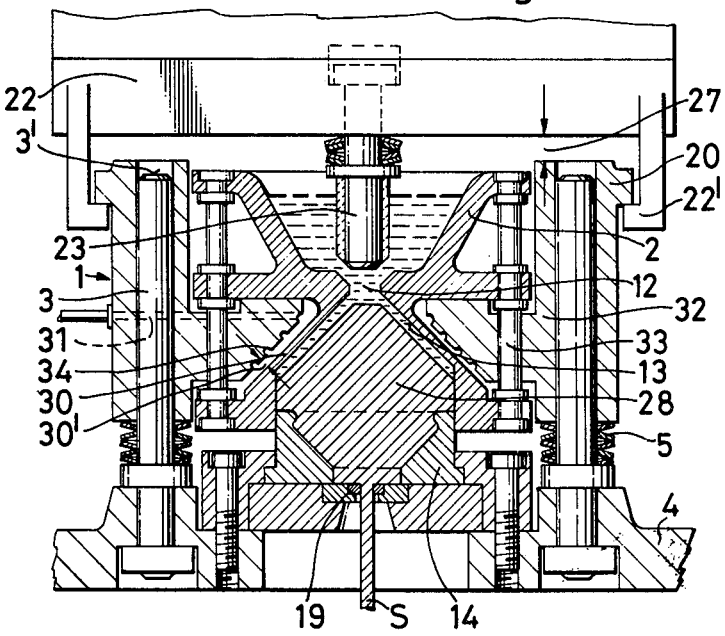
FIG. 10 is a vertical section through a second embodiment of the apparatus for carrying out the method according to the invention, the relative disposition of parts being appropriate to the commencement of the pressing stroke.

The construction of the second embodiment as shown in FIG. 10 differs from that of the first embodiment mainly in that, instead of the receiver bush 7 as the inner part of the receiver, a thin walled hollow cone 30 is used, for example made of copper or other good conducting material. The cone is connected with the casting funnel 2, and the whole is held together and is reinforced by a row of anchor bars 33 or the like arranged in circle to form a single construction part. A receiver guiding part 32 surrounds the aforementioned constructional part with a slight longitudinal play therebetween, the guiding part 32 similar to the receiver of FIG. 3, being guided on columns 3 which are fixed to the press counter-bearing 4. Similarly, the guiding part is connected to the pressure piece 22 for movement therewith, there being a "lost motion" 27 as before. As will be seen, there is present, in the initial position shown in FIG. 10, between the receiver guiding part 32 and the thin walled hollow cone 30, a gap 30' to which cooling water is fed through a channel 31 in the receiver guiding part. Thus, in this position, during the casting of a new molten mass, a particularly intensive cooling is obtained as a result of which the new layer is rapidly solidified, and a fusing thereof with the inner side of the thin wall of the hollow cone 30 will be avoided which inner side constitutes the cooling face 13.

During the subsequent lowering of the pressure piece 22, after the "lost motion" 27 necessary for the closing of the passage opening 12 by the stopper 23 has been traversed, the receiver guiding part 32 is taken along downwardly. Part 32 engages or will rest against the thin conical wall 30 whereby cooling grooves 34 in its contact face render possible the further cooling water flow. During the further downward movement of part 32, the thin wall of the hollow cone 30 is supported by such guide part 32 and thus can transmit the pressure onto the bar 28 by which a portion for lengthening the extrusion S is extruded.

For the remainder, the constructional arrangement and the manner of operation are the same as in the first embodiment.

It is, of course, to be understood that the present invention is, by no means, limited to the specific showing in the drawings, but also comprises any modifications within the scope of the appended claims.

What I claim is:

1. The method of extruding a continuous extrusion from molten material, comprising confining a mass of said material between two relatively movable members, the first member having a receiving compartment in which said mass is confined with the second member within said compartment, cooling the material in said compartment to a plastic state, one of said members having an inlet, the other member having an extrusion opening opposite said inlet and supporting said material and being relatively movable toward and away from said inlet, closing said inlet and moving said members relatively to move said second member inwardly into said compartment, exerting pressure on said mass and extruding a portion of said mass adjacent said other member through said extrusion opening, opening said inlet and moving said second member outwardly with said plastic mass and admitting a supply of said molten material into said compartment to form a layer of molten material on said plastic mass adjacent said inlet, closing said inlet to confine said material in said compartment and cool said layer, and repeating said cycle of moving said second member inwardly and outwardly relatively to said compartment while extruding a portion of the plastic mass in said compartment of each cycle.

2. A method in combination according to claim 1, which includes applying the extrusion pressure during the transformation of the respective last introduced batch of melt from the liquid to the thermal plastic state.

3. A method in combination according to claim 1 in which the surface of the introduced batch is cooled.

4. The method of extruding a continuous extrusion from molten material in successive steps, comprising admitting molten material to a receiving compartment through an inlet at the top of said receiving compartment to fill said receiving compartment, and cooling and maintaining the material in said receiving compartment in a plastic, extrudable state, closing said inlet at the top to confine said material in said receiving compartment, relatively moving a die supporting said material and having an extrusion opening and said compartment, so that said die moves upwardly and inwardly relative to said receiving compartment toward said inlet to exert pressure on said material and extrude said material adjacent said die through said opening, and further relatively moving said die and said compartment to move said die downwardly and outwardly relative to said receiving compartment with said extrusion and the remaining mass of said material, and opening said inlet at the top of said receiving compartment to form a layer on said mass of plastic material, and repeating said step successively to form a continuous extrusion of indefinite length.

5. A method in combination according to claim 4, in which the plastic material being built up layer-wise by said batches in the receiver is cooled only so far that it has extrusion temperature in the area to be extruded.

6. A method in combination according to claim 4, which includes reheating the plastic material being built up layer-wise in the receiving compartment until it reaches at least in the area to be extruded, the required extrusion temperature.

7. An apparatus for producing strands in the form of rods, tubes and profiled articles, which includes: a first housing section comprising a casting funnel adapted to be filled with a melt from which the strands to be produced are made, a second housing section comprising a receiving compartment for receiving melt from said casting funnel, conduit means establishing communication between said casting funnel and said receiving compartment, stopper to means operable selectively to move for interrupting communication between said casting funnel and said receiving compartment, pressing die means forming a plunger slidably extending into said compartment and operable to support a bar of the material of said melt in a thermal plastic condition and with each inward stroke of said die means relative to said compartment to extrude from said bar a section of a strand, a tool arranged on said die for shaping the cross section of said strand section, a thin wall bounding at least in part the inner space of said compartment and adapted to be cooled from the outside while being made of heat conducting material, and means for transmitting pressure force and adapted only during the pressing stroke to engage said wall for supporting the same.

8. An apparatus according to claim 7, in which said die means is provided with holding means for firmly holding said bar.

9. An apparatus according to claim 7, which includes a pressure piece for connection with a pressure plate of an upright press, said pressure piece being operable to move said first and second housing sections relative to said pressing die means.

10. An apparatus according to claim 9, which includes a resilient support, and in which said stopper means is connected to said pressure piece through said resilient support, the arrangement being such that a lost motion exists between said pressure piece and said compartment, said lost motion amounting to a distance slightly in excess of the stroke of said stopper means for closing said conduit means.

11. An apparatus according to claim 7, in which said stopper means includes means for water cooling the same, said stopper means also being provided with a heat insulating cover.

12. An apparatus according to claim 11, in which that end of said stopper means which faces said conduit means is provided with a conical chamfer for engagement with the adjacent end of said conduit means when closing the latter.

13. An apparatus according to claim 11, which includes a bushing means surrounding said compartment and provided with cooling means, that surface of said bushing means which faces said bar forming a cooling face, and in which actuating means operatively connected to said stopper means for actuating the same so that with the stroke of said pressure piece away from said compartment, the opening of the conduit means is then held closed so that between the bar firmly held on the die and the cooling face a heat insulating intermediate space results.

14. An apparatus according to claim 11, in which said stopper means is provided with a cover, and in which said stopper means is engageable with the adjacent end of said conduit means for displacement of the molten material located in said conduit means into said second section, said stopper cover being provided with a chamfer for cooperation with the adjacent opening of said conduit means.

15. An apparatus according to claim 11, in which said stopper means has such a length and its stroke is of such length that in its closing position said stopper means extends into said second section and constitutes a cooling pin for cooling said bar.

16. An apparatus according to claim 7, which includes guiding columns and a press counterbearing means connected to said columns, said columns guiding said second section, and spring means supporting said compartment against said press counterbearing means.

17. An apparatus for producing strands in the form of rods, tubes and profiled articles, which includes a first housing section adapted to be filled with a melt from which the strands to be produced are made, a second housing section comprising a receiving compartment for receiving melt from said first section, said receiving compartment having means to cool said melt to a plastic state, conduit means establishing communication between said first section and said receiving compartment, stopper means operable selectively to allow the melt to flow into said compartment and to move to block said conduit means for interrupting communication between said first section and said receiving compartment, pressing die means forming a plunger in said compartment, means to move said compartment and said plunger relative to each other so that said plunger is slidably movable inwardly and outwardly in said compartment and operable to support a bar of the material of said melt cooled into a uniform plastic condition, said die means including a tool having an extrusion opening, so that with each inward stroke of said die means relative to said compartment when said stopper means closes said conduit means, said die means progressively extrudes a portion of said bar through said opening to form a further quickly solidified section of a strand axially and radially fused progressively on successive movements of said die means.

18. An apparatus for producing strands in the form of rods, tubes and profiled articles, which includes: a first housing section comprising a casting funnel adapted to be filled with a melt from which the strands to be produced are made, a second housing section comprising a receiving compartment for receiving melt from said casting funnel, conduit means establishing communication between said casting funnel and said receiving compartment, stopper means operable selectively to move for interrupting communication between said casting funnel and said receiving compartment, pressing die means forming a plunger slidably extending into said compartment and operable to support a bar of the material of said melt in a thermal plastic condition and with each inward stroke of said die means relative to said compartment to extrude from said bar a section of a strand, a tool arranged on said die for shaping the cross section of said strand section, said stopper means including means for water cooling the same, said stopper means also being provided with a heat insulating cover, said stopper means being engageable with the adjacent end of said conduit means for displacement of the molten material located in said conduit means into said second section, said stopper cover being provided with a chamfer for cooperation with the adjacent opening of said conduit means, and separate driving means drivingly connected with said cover for longitudinally moving said cover on said stopper means so that with the stopper in its raised position said cover means masks the cylindrical face thereof.

19. An apparatus for producing strands in the form of rods, tubes and profiled articles, which includes: a first housing section comprising a casting funnel adapted to be filled with a melt from which the strands to be produced are made, a second housing section comprising a receiving compartment for receiving melt from said casting funnel, conduit means establishing communication between said casting funnel and said receiving compartment, stopper means operable selectively to move for interrupting communication between said casting funnel and said receiving compartment, pressing die means forming a plunger slidably extending into said compartment and operable to support a bar of the material of said melt in a thermal plastic condition and with each inward stroke of said die means relative to said compartment to extrude from said bar a section of a strand, a tool arranged on said die for shaping the cross section of said section, said stopper means including means for water cooling the same, said stopper means also being provided with a heat insulating cover, a bushing means surrounding said compartment and provided with cooling means, that surface of said bushing means which faces said bar forming a cooling face, and actuating means operatively connected to said stopper means for actuating the same so that with the stroke of said pressure piece away from said compartment, the opening of the conduit means is then held closed so that between the bar firmly held on the die and the cooling face a heat insulating intermediate space results, that space of said compartment which connects with the opening of said conduit means being designed by a non-planar cooled face for increasing the area of the cooling face.

20. An apparatus according to claim 19 in which said compartment is surrounded by a bushing having outer cooling grooves and is furthermore provided with an outer receiving cover arranged outwardly of said grooves, inlet and outlet conduit means being provided for supplying cooling fluid to and discharging the same from said cooling grooves.

21. An apparatus according to claim 19 in which the section of said compartment adjacent said cooling face is provided with heating means for heating the bar adjacent said tool.

* * * * *